US011715910B2

(12) United States Patent
Cheng et al.

(10) Patent No.: US 11,715,910 B2
(45) Date of Patent: Aug. 1, 2023

(54) CONNECTOR HAVING PAIRED SIGNAL CONTACTS SURROUNDED BY CONJOINED GROUNDING CONTACTS

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Shan-Yong Cheng, New Taipei (TW); Chih-Hsien Chou, San Jose, CA (US); Fang-Jwu Liao, New Taipei (TW); Chun-Yu Chao, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 152 days.

(21) Appl. No.: 17/401,314

(22) Filed: Aug. 13, 2021

(65) Prior Publication Data

US 2022/0052490 A1 Feb. 17, 2022

Related U.S. Application Data

(60) Provisional application No. 63/066,068, filed on Aug. 14, 2020.

(51) Int. Cl.
*H01R 13/6471* (2011.01)
*H01R 13/11* (2006.01)

(52) U.S. Cl.
CPC ..... *H01R 13/6471* (2013.01); *H01R 13/11* (2013.01)

(58) Field of Classification Search
CPC .. H01R 12/712; H01R 12/714; H01R 12/716; H01R 12/52; H01R 12/57; H01R 13/11; H01R 13/6471; H01R 13/41
USPC ..... 439/65, 66, 74
See application file for complete search history.

(56) References Cited

U.S. PATENT DOCUMENTS 6,805,561 B1 * 10/2004 Walkup ..... H01R 12/714 439/66
7,094,102 B2 8/2006 Cohen et al.
7,722,360 B2 * 5/2010 Millard ..... H01R 12/00 439/607.05
8,192,206 B1 * 6/2012 Ju ..... H01R 12/57 439/92
8,277,256 B2 * 10/2012 Ju ..... H01R 13/6588 439/626

(Continued)

*Primary Examiner* — Marcus E Harcum
(74) *Attorney, Agent, or Firm* — Ming Chieh Chang

(57) ABSTRACT

An electrical connector includes an insulative housing with plural passageways arranged in a hexagonal dense manner. Plural signal contacts and grounding contacts are disposed in the corresponding passageways, respectively, in a mixed manner wherein each pair of signal contacts are surrounded by eight grounding contacts. Some grounding contacts are aligned with one another along a row direction and linked together via a transverse bar, and a pair of extensions extend from the two opposite ends of the transverse bar in a column direction perpendicular to the row direction so as to have the pair of signal contacts essentially fully enclosed and shielded within a region with the boundary defined by a combination of the grounding contacts and the transverse bars.

19 Claims, 19 Drawing Sheets

(56) References Cited

U.S. PATENT DOCUMENTS

| | | | | |
|---|---|---|---|---|
| 8,491,337 | B2 * | 7/2013 | Cai | H01R 13/2407 439/66 |
| 8,535,093 | B1 * | 9/2013 | Mason | H01R 13/6585 439/607.05 |
| 9,048,591 | B2 * | 6/2015 | Chang | H01R 13/6597 |
| 9,065,216 | B2 * | 6/2015 | Chang | H01R 13/6585 |
| 9,240,657 | B2 * | 1/2016 | Chang | H01R 13/6588 |
| 9,325,118 | B2 * | 4/2016 | Chang | H01R 13/6588 |
| 10,236,635 | B2 * | 3/2019 | Ju | H01R 12/714 |
| 10,454,218 | B2 * | 10/2019 | Hsu | H01R 13/428 |
| 11,251,557 | B2 * | 2/2022 | Dai | H01R 43/16 |
| 2005/0026465 | A1 * | 2/2005 | Frutschy | H01R 12/523 439/74 |
| 2005/0054218 | A1 * | 3/2005 | Liao | H01R 13/2442 439/66 |
| 2010/0291774 | A1 * | 11/2010 | Cheng | H01R 13/2435 439/66 |
| 2011/0256771 | A1 * | 10/2011 | Jin | H01R 13/41 439/626 |
| 2012/0021625 | A1 * | 1/2012 | Horikawa | H01R 12/716 29/842 |
| 2013/0017721 | A1 * | 1/2013 | Mason | H01R 13/6585 439/607.08 |
| 2014/0038438 | A1 * | 2/2014 | Chang | H05K 7/1069 439/76.1 |
| 2014/0162472 | A1 * | 6/2014 | Walden | H01R 12/714 439/66 |
| 2019/0052021 | A1 * | 2/2019 | Hsu | H01R 13/2442 |
| 2019/0097334 | A1 * | 3/2019 | Cheng | H01R 12/7076 |
| 2020/0144747 | A1 * | 5/2020 | Cheng | H05K 3/325 |
| 2021/0203110 | A1 * | 7/2021 | Chen | H01R 13/2435 |

* cited by examiner

CONNECTOR HAVING PAIRED SIGNAL CONTACTS SURROUNDED BY CONJOINED GROUNDING CONTACTS

CROSS REFERENCE TO RELATED APPLICATIONS

This application claims the benefit of, and priority to, U.S. Provisional Patent Application No. 63/066,068, filed Aug. 14, 2020, the contents of which are incorporated entirely herein by reference.

BACKGROUND OF THE INVENTION

1. Field of the Invention

The present invention relates generally to an electrical connector for use with the CPU (Central Processing Unit), and particularly to the CPU socket having paired signal contacts surrounded by the conjoined grounding contacts.

2. Description of Related Arts

As shown in FIGS. 1-3, the prior connector includes an insulative housing 90 with a plurality of passageways arranged in a hexagonal manner wherein a pair of signal contacts S are surrounded by eight grounding contacts G from n1 to n8 performing shielding thereof. Anyhow, there are still many gaps D between the adjacent grounding contacts to allow noise escaping disadvantageously.

It is desirable to provide a CPU socket with the contacts arranged in a hexagonal dense manner with the grounding contacts configured with better shielding effect with regard to the paired signal contacts surrounded by the grounding contacts.

SUMMARY OF THE INVENTION

To achieve the above object, an electrical connector comprises: an insulative housing including a plurality of passageways extending therethrough in a vertical direction and arranged in a hexagonal manner. Plural pairs of signal contacts and a plurality of grounding contacts disposed in the corresponding passageways, respectively, and intermixed with each other wherein each pair of signal contacts is surrounded by eight grounding contacts so as to form several groups each having the pair of signal contacts in a middle row. Three grounding contacts in an upper row, other three grounding contacts in a lower row, and other two grounding contacts in the middle row by two sides of the pair of signal contacts; and in each group, the three grounding contacts in the upper row are unified as one set by a transverse bar extending in a transverse direction, and the three grounding contacts in the lower row are unified together by another transverse bar extending in said transverse direction.

To achieve the above object, an electrical connector comprises: an insulative housing including a plurality of passageways extending therethrough in a vertical direction and arranged in a hexagonal manner and defining both a column direction and a row direction perpendicular to each other and commonly perpendicular to the vertical direction. Plural pairs of signal contacts and a plurality of grounding contacts disposed in the corresponding passageways, respectively, and intermixed with each other wherein each pair of signal contacts is surrounded by eight grounding contacts so as to form several groups each having the pair of signal contacts in a middle row in the row direction. Three grounding contacts in an upper row in the row direction, other three grounding contacts in a lower row in the row direction, and other two grounding contacts in the middle row by two sides of the pair of signal contacts in the row direction; each of the signal contacts and the grounding contacts includes a deflectable upper arm arranged either of a straight type or an offset type. The upper arms belonging to the straight type and those belonging to the offset type are alternately arranged with each other along the row direction in a relationship of three columns of the straight type vs. two columns of the offset type or one column of the straight type vs. four columns of the offset type.

To achieve the above object, an electrical connector comprises: an insulative housing including a plurality of passageways extending therethrough in a vertical direction and arranged in a hexagonal manner and defining both a column direction and a row direction perpendicular to each other and commonly perpendicular to the vertical direction. Plural pairs of signal contacts and a plurality of grounding contacts disposed in the corresponding passageways, respectively, and intermixed with each other wherein each pair of signal contacts is surrounded by eight grounding contacts so as to form several groups each having the pair of signal contacts in a middle row in the row direction, three grounding contacts in an upper row in the row direction, other three grounding contacts in a lower row in the row direction, and other two grounding contacts in the middle row by two sides of the pair of signal contacts in the row direction. Each outermost grounding contacts in the upper row forms a cross section extending in the column direction and aligned, in the column direction, with another corresponding cross section of the grounding contact in the lower row and further aligned, in the column direction, with another cross section of the grounding contact in the middle row.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
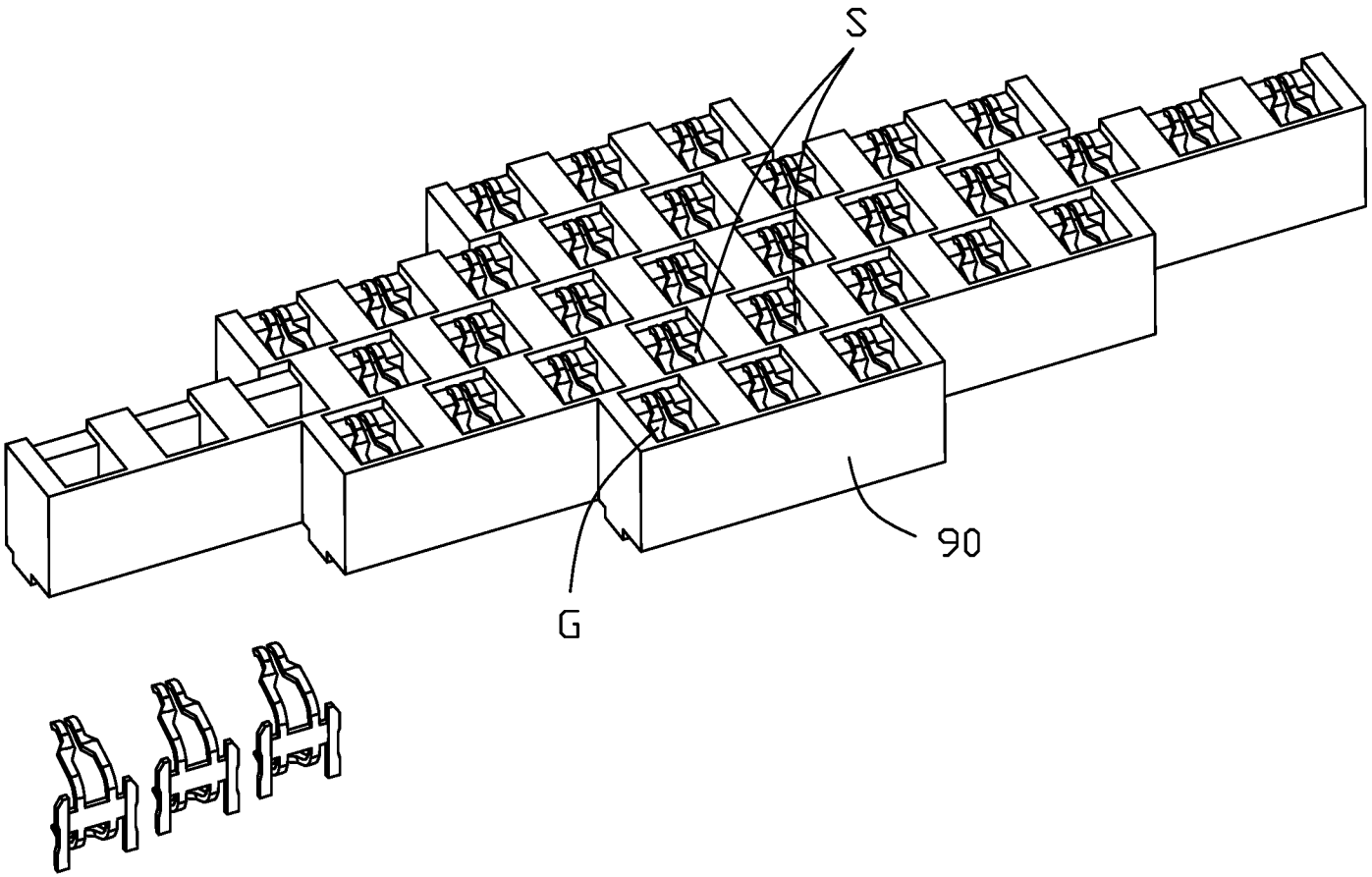
FIG. 1 (PRIOR ART)
FIG. 1 is a perspective view of the traditional CPU socket.
Figure 2:
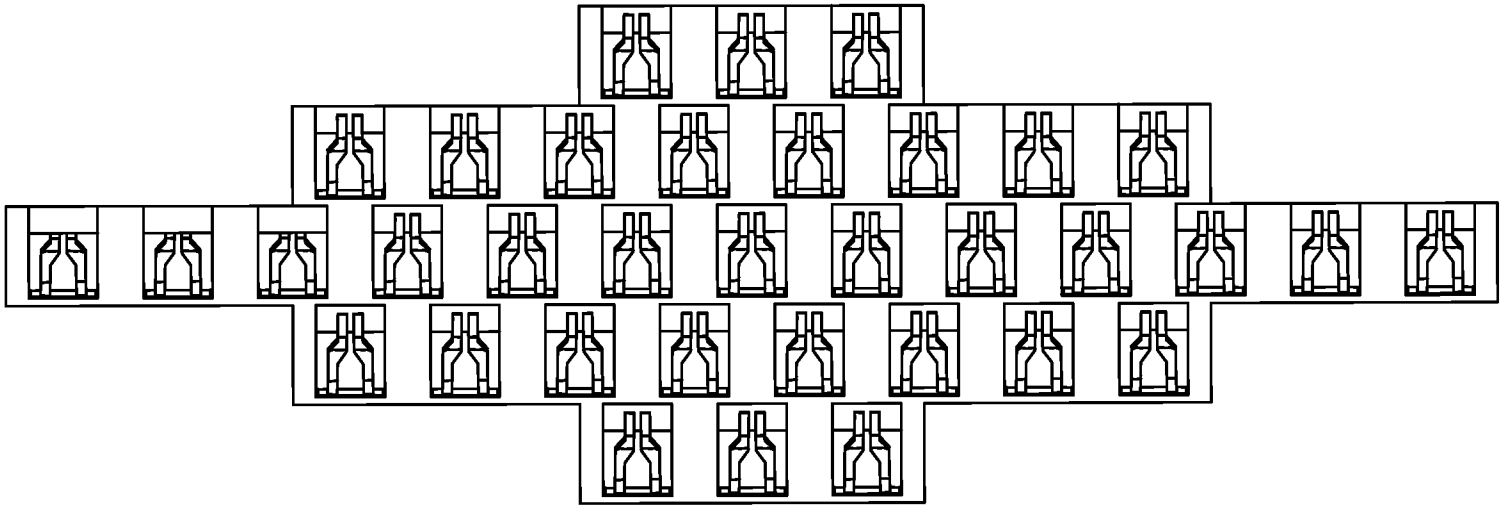
FIG. 2 (PRIOR ART)
FIG. 2 is a top view of the CPU socket of FIG. 1.
Figure 3:
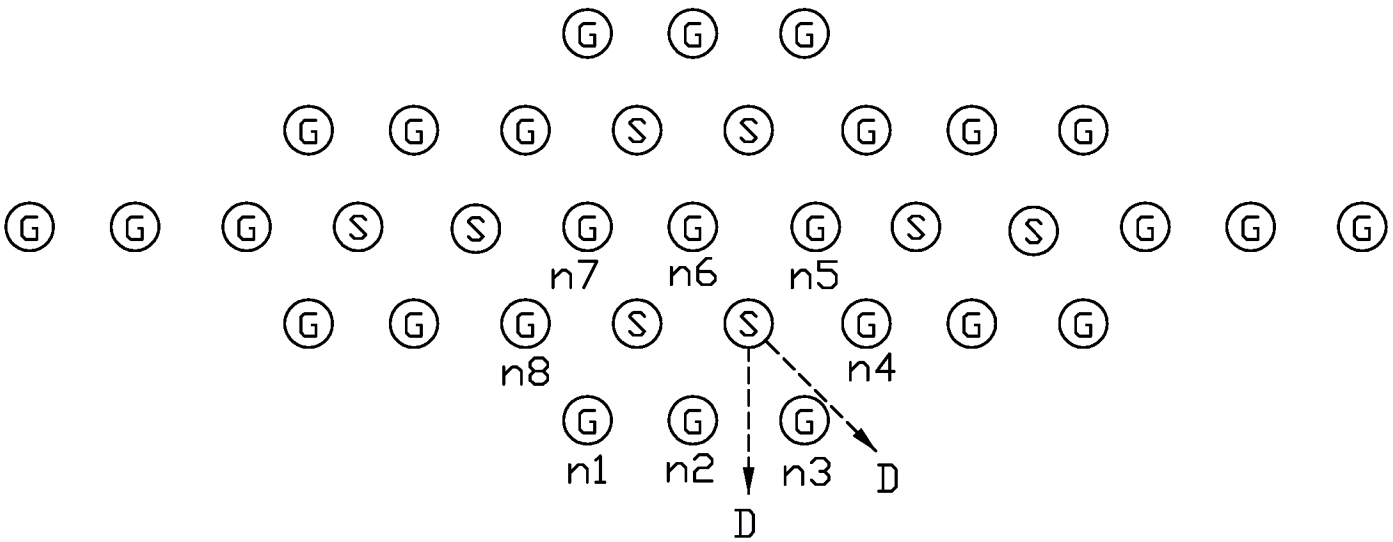
FIG. 3 (PRIOR ART)
FIG. 3 is a diagram showing the arrangement of the signal contacts and the grounding contacts in a mixed manner of the CPU socket of FIG. 1.

Referring to FIGS. 4-11, an electrical connector 100, a CPU socket in this embodiment, includes an insulative housing 110 with a plurality of passageways 120 extending therethrough in a vertical direction. The passageways 120 are arranged in a hexagonal manner wherein the row direction X and the column direction Y are defined. A plurality of paired signal contacts 130 and a plurality of grounding contacts 140 are intermixed with each other and respectively disposed within the corresponding passageways 120 wherein each pair of signal contacts 130, i.e., a differential pair, is essentially surrounded by eight grounding contacts 140 to form a group. Notably, in a top view, for each group the pair of signal contacts 130 are located in the middle row, three grounding contacts 140 are located in the upper row and other three grounding contacts 140 are located in the lower row, and other two grounding contacts 140 are located in the middle row and by two sides of the pair of signal contacts 130. Notably, the neighboring two groups share the same boundary grounding contacts 140.

Figure 8:
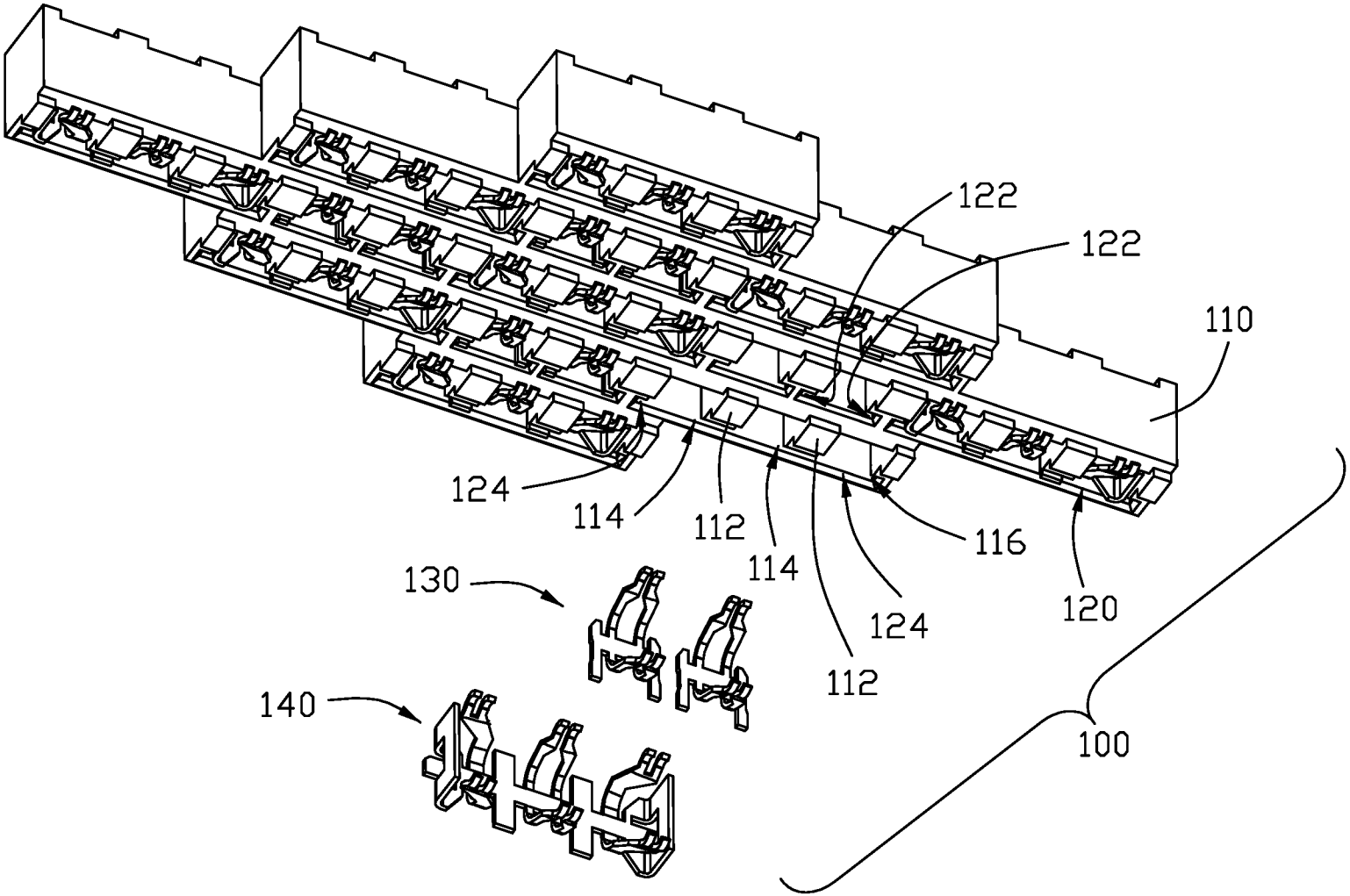
FIG. 8 is a perspective view of the CPU socket of FIG. 6 with a pair of signal contacts and a set of grounding contacts removed from the housing.
Figure 9:
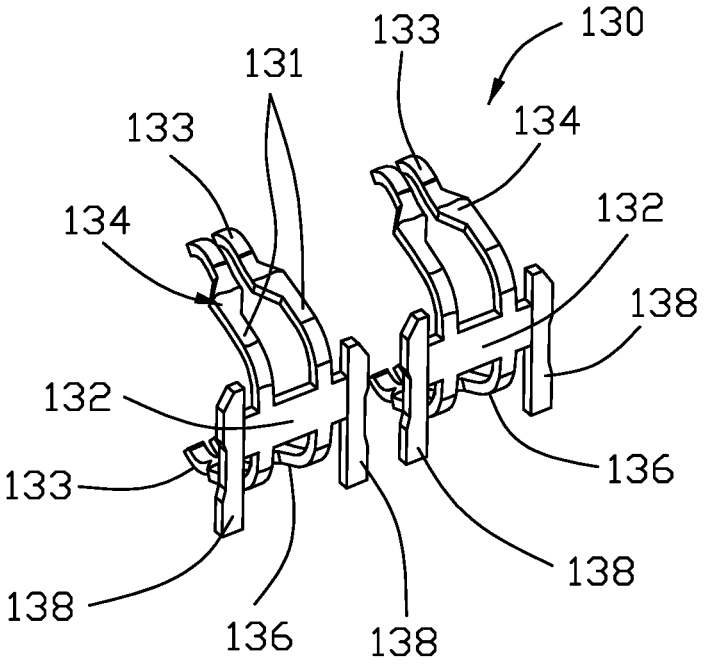
FIG. 9 is a perspective view of the pair of signal contacts of the CPU socket of FIG. 7.
Figure 10:
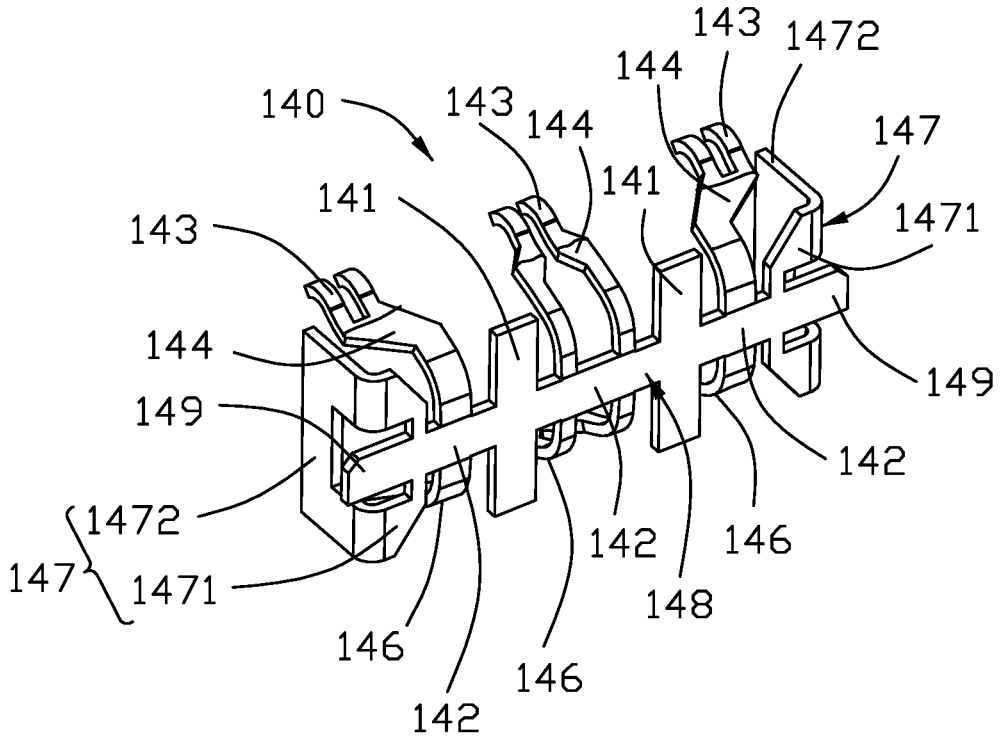
FIG. 10 is a perspective view of a set of grounding contacts of the CPU socket of FIG. 7.
Figure 11:
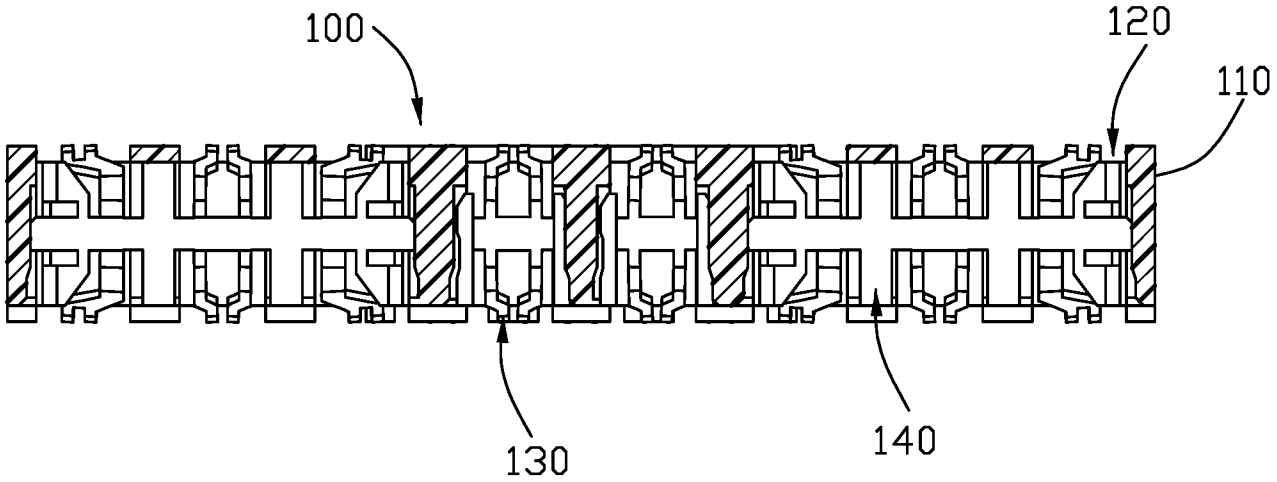
FIG. 11 is a cross-sectional view of the CPU socket taken along broken lines 11-11 in FIG. 4.

Each of the signal contacts 130 includes a transversely extending middle base 132 from which opposite deflectable upper arm 134 and lower arm 136 obliquely extend, and of which a pair of retaining poles 138 are formed at two opposite ends. Understandably, the upper arm 134 contacts the CPU and the lower arm contact the PCB (Printed Circuit Board) in this embodiment. Correspondingly, the passageway 120, which receives the corresponding signal contact 130, forms a pair of slits 122 to retain the corresponding retaining poles 138 therein. Similar to the signal contact 130, each grounding contact 140 includes a transversely extending middle base 142, and opposite deflectable upper arms 144 and lower arm 146 extend therefrom obliquely. In each group, the three grounding contacts 140 in the upper row as a set are unified together via a transverse bar 148 extending in the row direction, of which the middle bases 142 are formed. A pair of abutment poles 141 extend from the transverse bar 148 and are aligned, in the column direction, with the corresponding partition walls 112 which are respectively located between the corresponding adjacent two passageways 120. Two opposite tips 149 of the transverse bar 148 are retained in the corresponding retaining slits 124 formed at the corresponding passageways 120. A pair of expanded blades 147 are formed at two opposite ends of the transverse bar 148 wherein each blade 147 includes a transverse section 1471 extending from the transverse blade 147 in a coplanar manner, and a cross section 1472 extending in the column direction Y. It should be noted that as shown in FIG. 8, a gap 114 is formed between the middle two partition walls 112 which extend in the column direction, and the elongated wall 116 which extends in the row direction so as to not only allow the transverse bar 148 to pass but also retain the corresponding abutment pole 141 therein.

Figure 4:
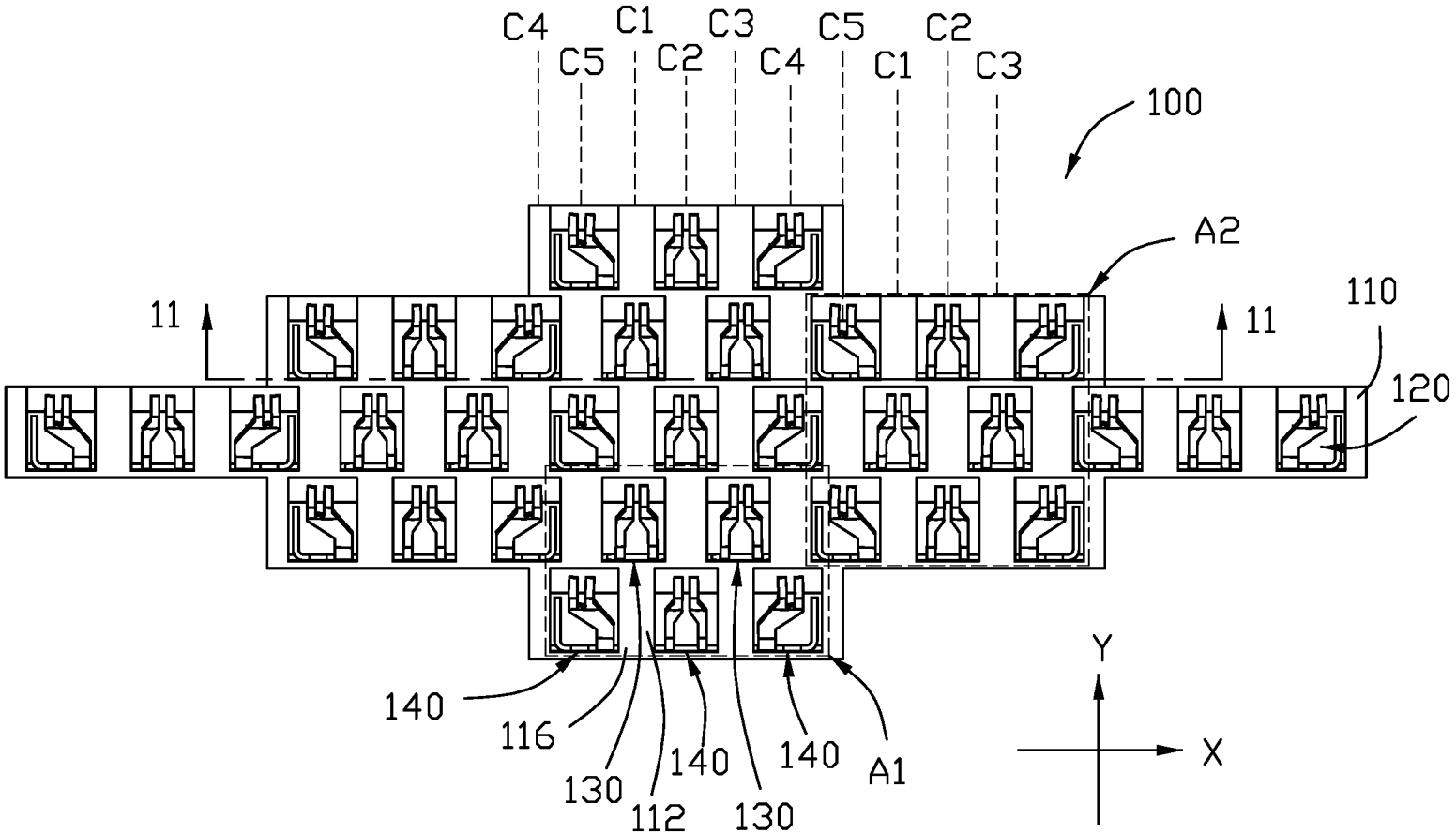
FIG. 4 is a top view of the CPU socket according to a first embodiment of the invention.
Figure 5:
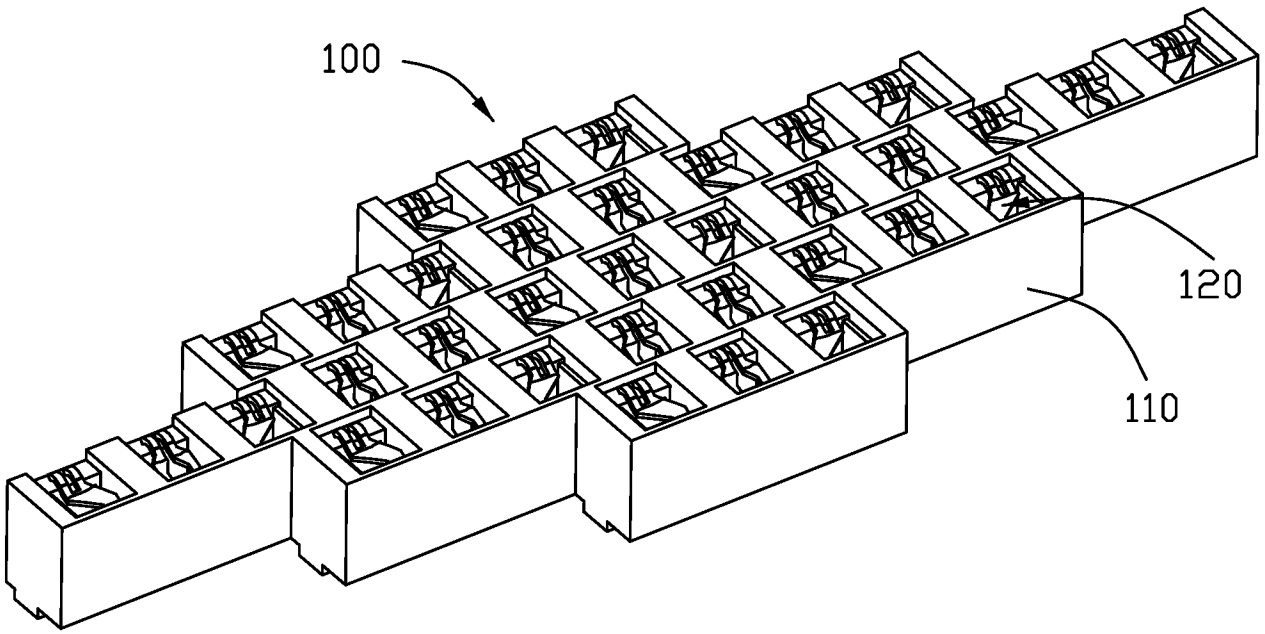
FIG. 5 is a perspective view of the CPU socket of FIG. 4.
Figure 6:
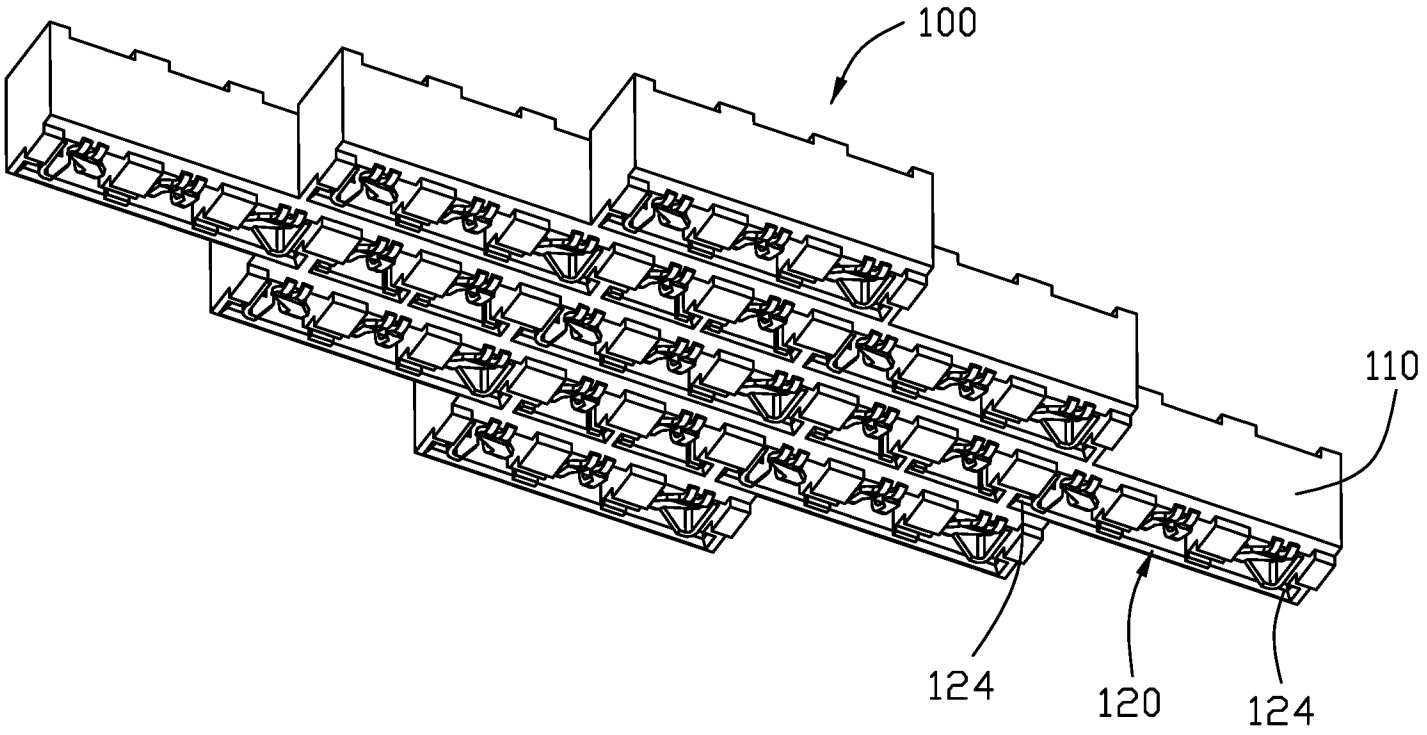
FIG. 6 is another perspective view of the CPU socket of FIG. 5.
Figure 7:
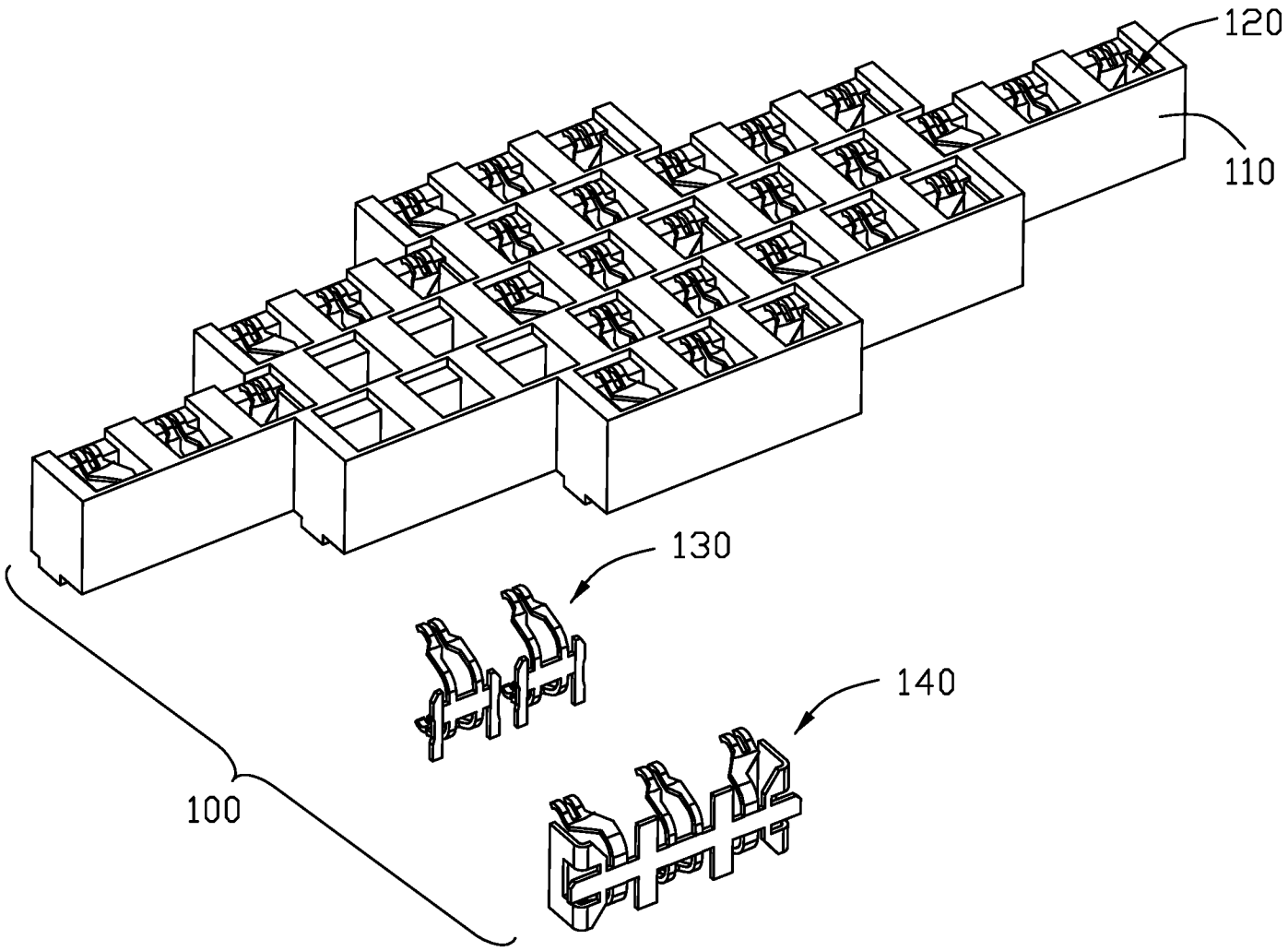
FIG. 7 is a perspective view of the CPU socket of FIG. 5 with a pair of signal contacts and a set of grounding contacts removed from the housing.

In this embodiment, the upper arm 134 or the lower arm 136 of the signal contact 130 includes a pair of fingers 131 with the corresponding contacting regions 133 offset toward each other. Similarly, the middle one of the set of grounding contacts 140 in either the upper row or the lower row has the same configuration with the signal contact 130 while the two grounding contacts 140 by two sides of the middle one of each set of grounding contacts 140 have the corresponding contacting regions 143 offset away from each other so as to approach the cross sections 1472 of the corresponding blades 147. In fact, because the contacting regions 143 are predetermined for compliance with the true position of the pads of the CPU, the upper arm 144 of the grounding contact 140 at either sides in each set of grounding contacts extends from an inner/inward position in the corresponding passageway 120 in the row direction. As shown in FIG. 4, for each group, the shielding area is formed by the transverse bar 148 of the set of grounding contacts 140 in the lower row, and that in the upper row, and the cross sections 1472 of the blades 147 of the grounding contacts 140 in the lower row and in the middle row. Understandably, the shielding area A1 may be deemed to include all portions of the set of grounding contacts 140 as shown with the shielding area A2 in FIG. 4. Disregarding how to regard the smaller shielding area A1 and the larger shielding area A2, in each group the pair of signal contacts 130 is effectively shielded in a top view. In this embodiment, both the signal contacts 130 and the grounding contacts 140 are upwardly assembled into the housing 110. Notably, disregarding whether the upper arm and the lower arm extend in an offset manner, i.e., the signal contacts 130, or a straight manner, i.e., the two side grounding contacts 140, the contacting regions 133 of the signal contacts 130 and the contacting regions 143 of the grounding contacts 140 are always located at the corresponding hexagonal positions in compliance with the true positions of the pads on the CPU and the PCB. It is also noted that as shown in FIG. 5, in each group the cross sections 1472 of the set of grounding contacts 140 in the upper row and in the lower row are aligned with the cross section 1472 of the grounding contact 140 in the middle row in the column direction for enhancing the shielding effect.

FIGS. 12-19 show a second embodiment of the invention. The difference between the first embodiment and the second embodiment is that in each group the upper/lower arms 134'/136' of the pair of signal contacts 130' have the same shape with two opposite outer grounding contacts 140' of each set of grounding contacts 140' to be offset outwardly away from the middle position. In other words, the upper/lower arm 134'/136' of each signal contact 130' extends from an inner/inward position in the corresponding passageway 120' with the outward contacting regions 133' away from each other in the row direction. Similar to the signal contacts in the first embodiment, the two poles 138' at two opposite ends of the base function as the retaining means.

Figure 12:
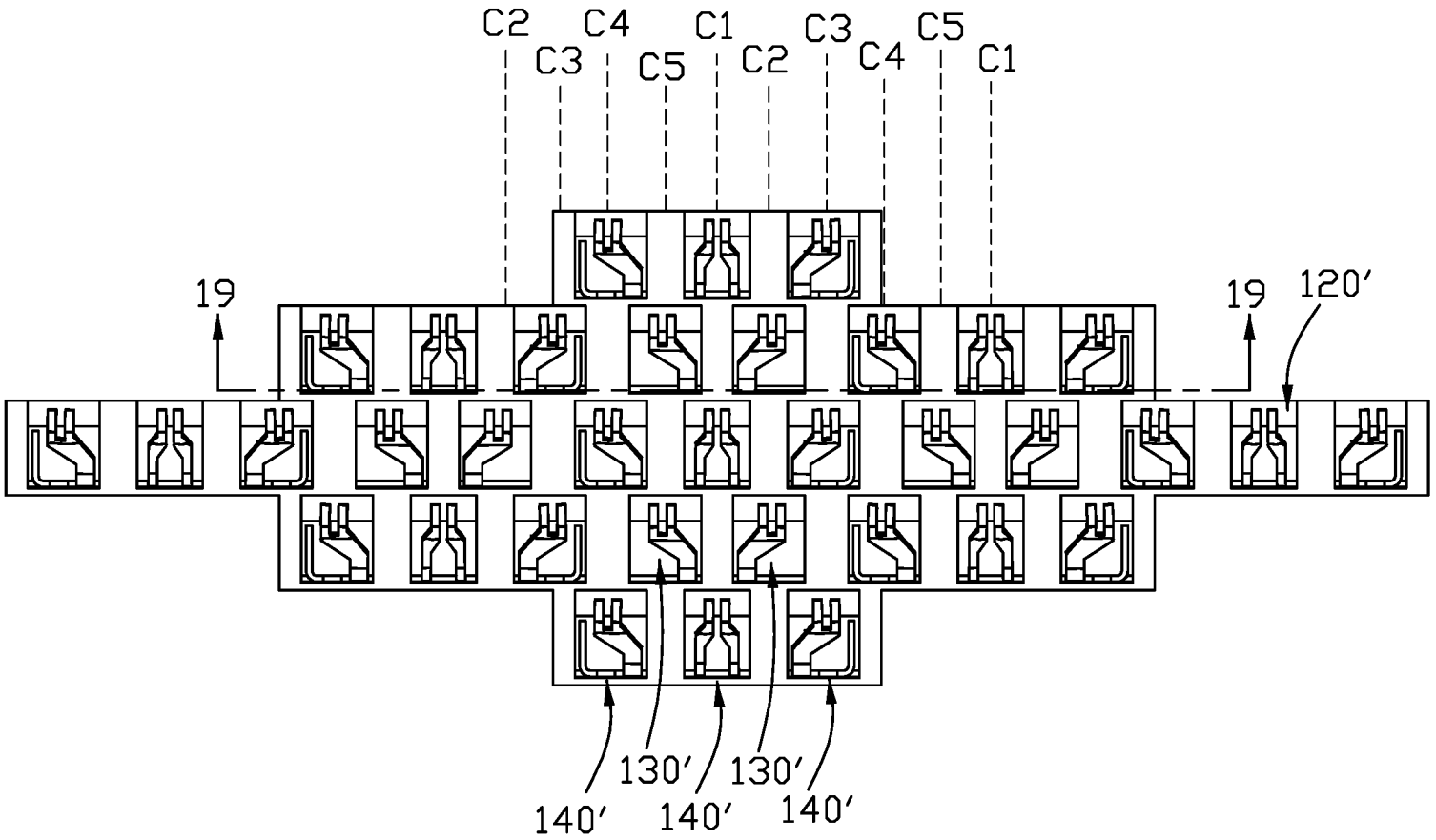
FIG. 12 is a top view of a CPU socket according to a second embodiment of the invention.
Figure 13:
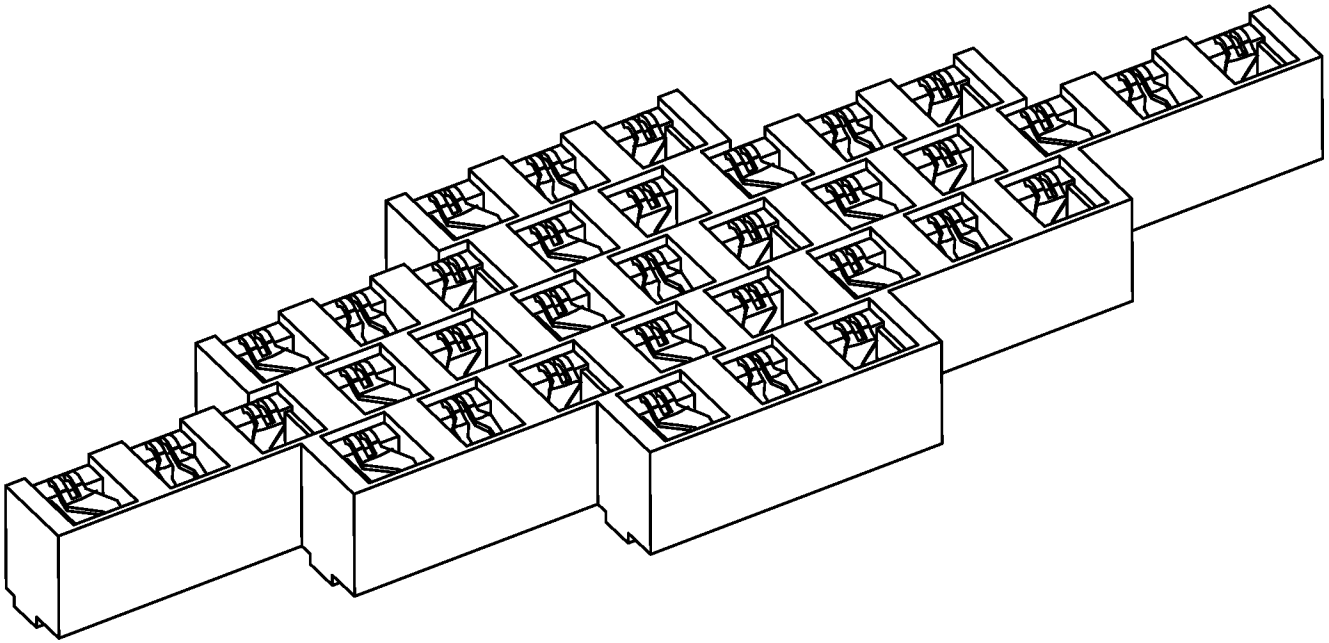
FIG. 13 is a perspective view of the CPU socket of FIG. 12.
Figure 14:
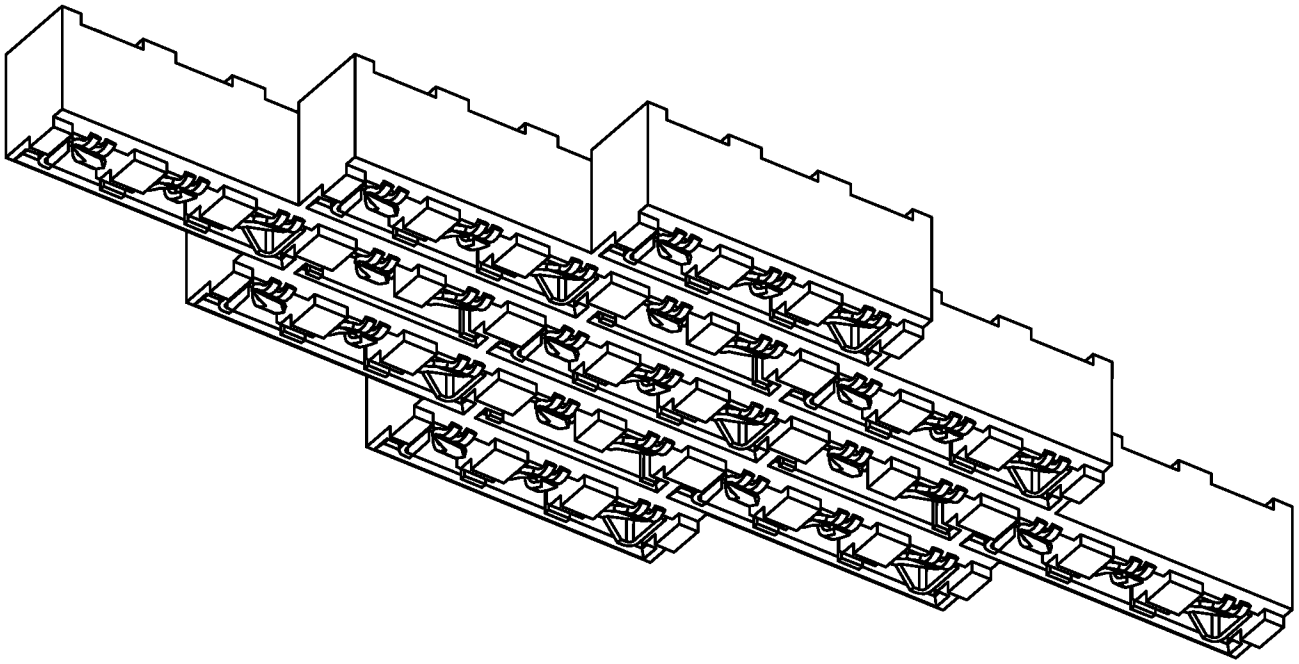
FIG. 14 is another perspective view of the CPU socket of FIG. 13.
Figure 15:
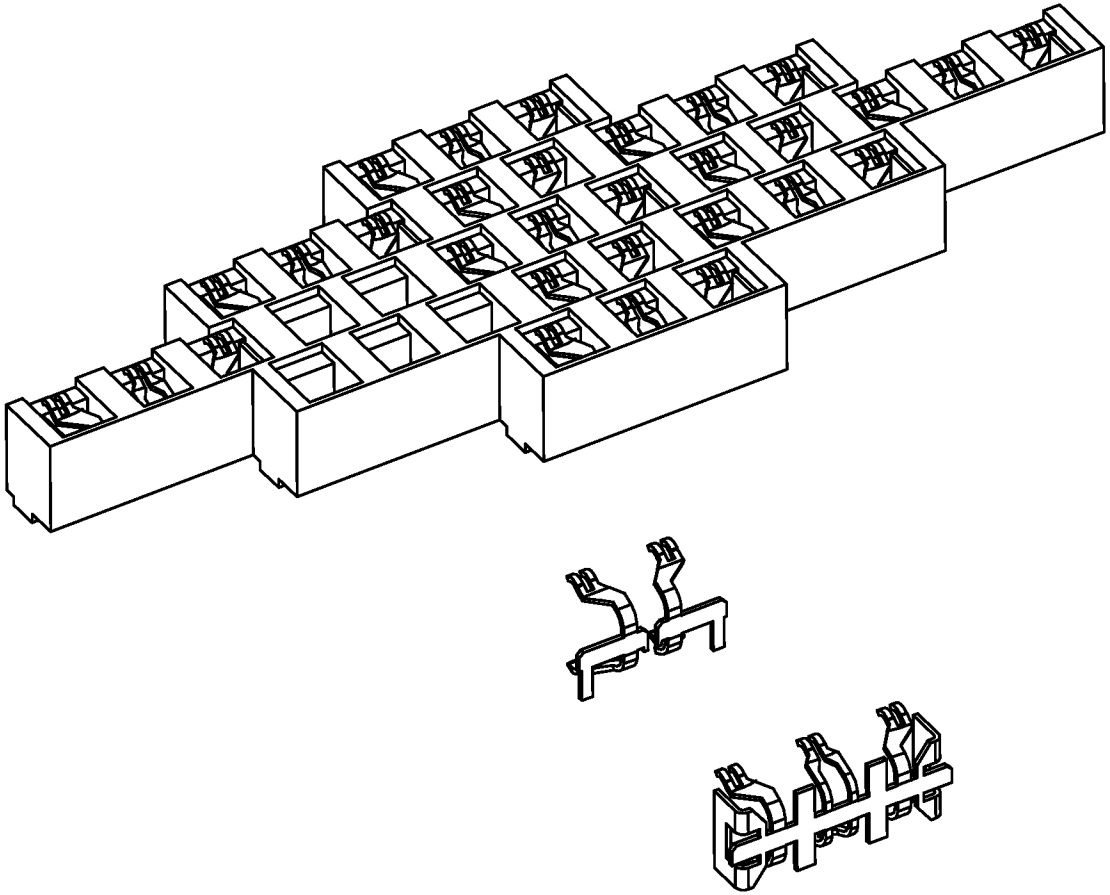
FIG. 15 is a perspective view of the CPU socket of FIG. 13 with a pair of signal contacts and a set of grounding contacts removed away from the housing.
Figure 16:
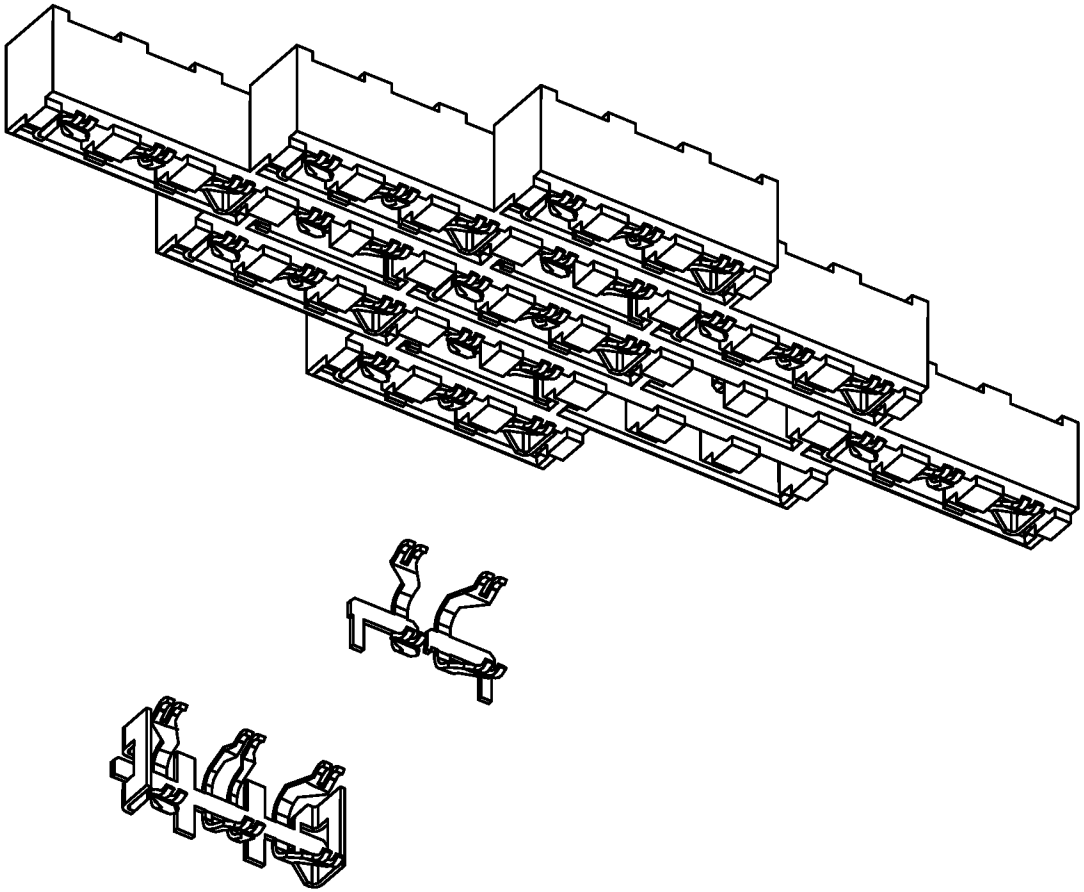
FIG. 16 is a perspective view of the CPU socket of FIG. 14 with the pair of signal contacts and the set of grounding contacts removed away from the housing.
Figure 17:
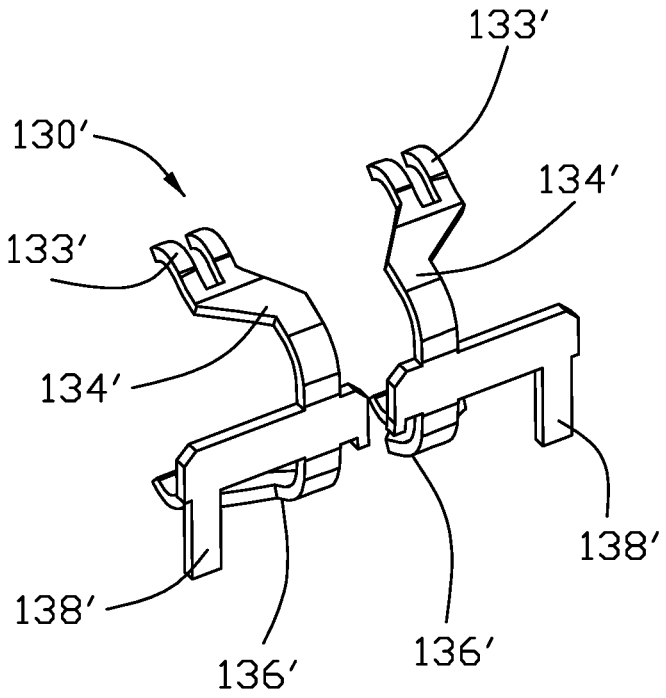
FIG. 17 is a perspective view of the pair of signal contacts of the CPU socket of FIG. 12.
Figure 18:
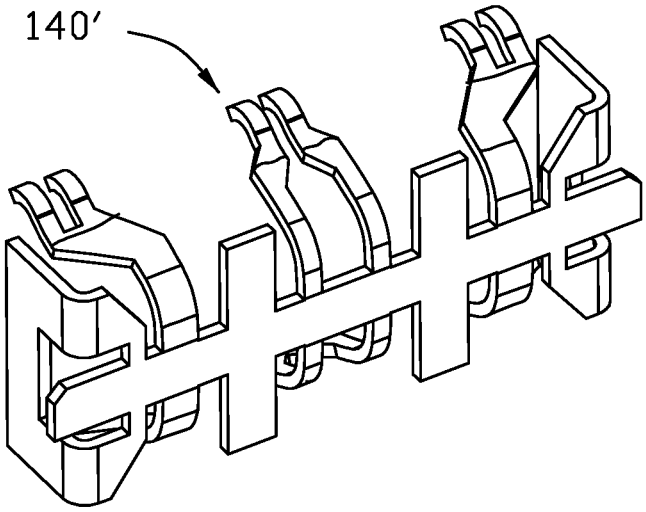
FIG. 18 is a perspective view of a set of grounding contacts of the CPU socket of FIG. 12 which is essentially same with FIG. 10.
Figure 19:
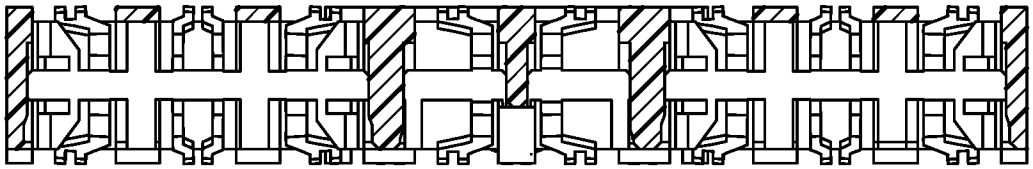
FIG. 19 is a cross-sectional view of the CPU socket taken along broken lines 19-19 in FIG. 12.

The difference between the first embodiment and the second embodiment may also refer to FIGS. 4 and 12. In FIG. 4, in the top view the upper arms of both the signal contacts 130 and the grounding contacts 140 may have two types wherein the symmetry type as shown in the signal contact 130 and the middle grounding contacts 140 occupy three columns C1, C2 and C3 as a first unit while the offset type as shown in the two side grounding contacts 140 occupy two columns C4 and C5 as a second unit, and the first unit and the second unit alternately arranged with each other in the row direction. Differently, in FIG. 12, in a top view the upper arms of both the signal contacts and the grounding contacts may also have two types wherein the symmetry type as show in the middle grounding contacts 140' occupy only one column C1' as a first unit while the offset type as shown in both the signal contacts 130' and the two side grounding contacts 140' occupy four columns C2, C3, C4 and C5 as a second unit, and the first unit and the second unit are alternate arranged with each other in the row direction. From another technical viewpoint, in the first embodiment, the upper/lower arms of the pair of signal contacts are symmetrically arranged with each other while are not symmetrically arranged with the neighboring grounding contacts in the same row. Differently, in the second embodiment, the pair of signal contacts are symmetrically arranged not only with each other but also with the neighboring grounding contacts in the same row.

However, the disclosure is illustrative only, changes may be made in detail, especially in matter of shape, size, and arrangement of parts within the principles of the invention.

What is claimed is:

1. An electrical connector comprising:

an insulative housing comprising a plurality of passageways extending therethrough in a vertical direction and arranged in a hexagonal manner; and plural pairs of signal contacts and a plurality of grounding contacts disposed in the corresponding passageways, respectively, and intermixed with each other;

each pair of signal contacts being surrounded by eight grounding contacts so as to form several groups each having the pair of signal contacts in a middle row, three grounding contacts in an upper row, other three grounding contacts in a lower row, and other two grounding contacts in the middle row by two sides of the pair of signal contacts;

wherein in each group, the three grounding contacts in the upper row are unified as one set by a transverse bar extending in a transverse direction, and the three grounding contacts in the lower row are unified together by another transverse bar extending in the transverse direction.

2. The electrical connector as claimed in claim 1, wherein in each group, each grounding contact located by either sides of the pair of signal contacts in the middle row is unified with other two grounding contacts via another transverse bar belonging to another group.

3. The electrical connector as claimed in claim 1, wherein each of the grounding contacts includes a middle base with an obliquely extending deflectable upper arm having a contacting region.

4. The electrical connector as claimed in claim 3, wherein in each group the upper arms of the grounding contacts at two sides in the upper row and those in the lower row are of an offset type while the upper arm of the middle one of the grounding contacts in the upper row and those in the lower row are of a straight type.

5. The electrical connector as claimed in claim 4, wherein in each group the upper arms of the grounding contacts by two sides of the pair of signal contacts in the same row are of the offset type.

6. The electrical connector as claimed in claim 4, wherein in each group the upper arms of the pair of signal contacts are symmetrically arranged with each other.

7. The electrical connector as claimed in claim 6, wherein in each group the upper arm of the signal contact is symmetrically arranged with that of another signal contact in the same pair while asymmetrically arranged with that of the neighboring grounding contact in the same row.

8. The electrical connector as claimed in claim 7, wherein the upper arms of the signal contacts are of a straight type while the that of the neighboring grounding contact is of an offset type.

9. The electrical connector as claimed in claim 6, wherein in each group the upper arm of the signal contact is symmetrically arranged with that of another signal contact in the same pair and is symmetrically arranged with that of the neighboring grounding contact in the same row.

10. The electrical connector as claimed in claim 9, wherein both the upper arm of the signal contact and that of the neighboring grounding contact are of an offset type.

11. The electrical connector as claimed in claim 1, wherein in each set of grounding contacts, a pair of expanded blades are formed at two opposite ends in the transverse bar, and each expanded blade includes a cross section extending in a direction perpendicular to the transverse direction.

12. The electrical connector as claimed in claim 1, wherein in each group the pair of signal contacts are symmetrically arranged with each other.

13. The electrical connector as claimed in claim 1, wherein the insulative housing forms a gap between a partition wall and an elongated wall around the corresponding passageways to receive the transverse bar.

14. The electrical connector as claimed in claim 13, wherein in each group the transverse bar includes an abutment pole received within the corresponding gap.

15. An electrical connector comprising:

an insulative housing including a plurality of passageways extending therethrough in a vertical direction and arranged in a hexagonal manner and defining both a column direction and a row direction perpendicular to each other and commonly perpendicular to the vertical direction; and plural pairs of signal contacts and a plurality of grounding contacts disposed in the corresponding passageways, respectively, and intermixed with each other wherein each pair of signal contacts is surrounded by eight grounding contacts so as to form several groups each having the pair of signal contacts in a middle row in the row direction, three grounding contacts in an upper row in the row direction, other three grounding contacts in a lower row in the row direction, and other two grounding contacts in the middle row by two sides of the pair of signal contacts in the row direction; wherein each of the signal contacts and the grounding contacts includes a deflectable upper arm arranged either of a straight type or an offset type; wherein the upper arms belonging to the straight type and those belonging to the offset type are alternately arranged with each other along the row direction in a relationship of: three columns of the straight type and two columns of the offset type; or one column of the straight type and four columns of the offset type.

16. The electrical connector as claimed in claim 15, wherein each group has seven neighboring columns.

17. The electrical connector as claimed in claim 16, wherein the upper arms of the signal contacts are of the straight type when the relationship is of the three column of the straight type and the two columns of the offset type.

18. The electrical connector as claimed in claim 16, wherein the upper arms of the signal contacts of the offset type when the relationship is of the one column of the straight type and the four columns of the offset type.

19. An electrical connector comprising: an insulative housing including a plurality of passageways extending therethrough in a vertical direction and arranged in a hexagonal manner and defining both a column direction and a row direction perpendicular to each other and commonly perpendicular to the vertical direction; and plural pairs of signal contacts and a plurality of grounding contacts disposed in the corresponding passageways, respectively, and intermixed with each other wherein each pair of signal contacts is surrounded by eight grounding contacts so as to form several groups each having the pair of signal contacts in a middle row in the row direction, three grounding contacts in an upper row in the row direction, other three grounding contacts in a lower row in the row direction, and other two grounding contacts in the middle row by two sides of the pair of signal contacts in the row direction; wherein each outermost grounding contact in the upper row forms a cross section extending in the column direction and aligned, in the column direction, with another corresponding cross section of the grounding contact in the lower row, and the cross section is further aligned, in the column direction, with another cross section of the grounding contact in the middle row; and wherein in each group the grounding contacts in the upper row are unified together as one set by a transverse bar extending in the row direction, and the grounding contacts in the lower row are unified together as another set by another transverse bar extending in the row direction.

* * * * *